US010494743B2

(12) United States Patent
Beavers et al.

(10) Patent No.: US 10,494,743 B2
(45) Date of Patent: Dec. 3, 2019

(54) YARN TEXTURIZING APPARATUS AND METHOD

(71) Applicant: Columbia Insurance Company, Omaha, NE (US)

(72) Inventors: Larry Aldon Beavers, Chatsworth, GA (US); Joe Plemmons, Blue Ridge, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 606 days.

(21) Appl. No.: 15/094,406

(22) Filed: Apr. 8, 2016

(65) Prior Publication Data

US 2016/0298270 A1 Oct. 13, 2016

Related U.S. Application Data

(60) Provisional application No. 62/144,721, filed on Apr. 8, 2015.

(51) Int. Cl.

| | |
|---|---|
| ***D02G 3/28*** | (2006.01) |
| ***D02J 1/08*** | (2006.01) |
| ***D02G 1/02*** | (2006.01) |
| ***D02G 1/16*** | (2006.01) |
| ***D02G 1/20*** | (2006.01) |

(52) U.S. Cl.

CPC ..... *D02G 3/286* (2013.01); *D02G 1/028* (2013.01); *D02G 1/0266* (2013.01); *D02G 1/161* (2013.01); *D02G 1/168* (2013.01); *D02G 1/20* (2013.01); *D02J 1/08* (2013.01)

(58) Field of Classification Search

CPC ..... D02G 1/0266; D02G 1/168; D02G 1/20; D02G 3/286

See application file for complete search history.

(56) References Cited

U.S. PATENT DOCUMENTS

| | | | |
|---|---|---|---|
| 2,926,483 | A | 3/1960 | Keeler et al. |
| 3,328,226 | A | 6/1967 | Wiley |

(Continued)

FOREIGN PATENT DOCUMENTS

| | | | |
|---|---|---|---|
| CA | 2553462 | A1 | 8/2005 |
| EP | 0292266 | A2 | 11/1988 |

(Continued)

OTHER PUBLICATIONS

International Search Report and Written Opinion were dated Jul. 5, 2016 for Application No. PCT/US2016/026724, which was filed on Apr. 8, 2016 (Inventor—Beavers et al; Applicant—Shaw Industries Group, Inc.) (15 pages).

(Continued)

*Primary Examiner* — Shaun R Hurley

(74) *Attorney, Agent, or Firm* — Ballard Spahr LLP

(57) ABSTRACT

A yarn texturizing apparatus and method for texturizing a plurality of yarns, which can include a tack assembly and a jet box assembly. The tack assembly can be configured to receive a bundle of yarns and impart a plurality of twists to each bundle of yarns and subsequently impart a first tack point at a point corresponding to a twist reversal between the twists. The downstream jet box assembly can be configured to place a plurality of additional tack points intermittently along the plurality of twists of each bundle of yarn.

20 Claims, 6 Drawing Sheets

(56) References Cited

U.S. PATENT DOCUMENTS

| | | | | | |
|---|---|---|---|---|---|
| 3,441,231 | A | | 4/1969 | Siegel | |
| 3,468,120 | A | | 9/1969 | Hildebrand | |
| 3,653,196 | A | | 4/1972 | Pike | |
| 3,701,248 | A | | 10/1972 | Gray | |
| 3,775,955 | A | * | 12/1973 | Shah | D02G 3/286 57/204 |
| 4,100,725 | A | | 7/1978 | Magel | |
| 4,114,549 | A | | 9/1978 | Chambley et al. | |
| 4,157,420 | A | | 6/1979 | Bourrain et al. | |
| 4,212,152 | A | | 7/1980 | Roman | |
| 4,364,998 | A | | 12/1982 | Wei | |
| 4,565,063 | A | | 1/1986 | Stalder et al. | |
| 4,729,151 | A | | 3/1988 | Runyon et al. | |
| 4,932,107 | A | | 6/1990 | Gotoh et al. | |
| 5,012,636 | A | | 5/1991 | Hallam et al. | |
| 5,179,827 | A | * | 1/1993 | Tinsley | D02G 3/286 57/204 |
| 5,228,282 | A | * | 7/1993 | Tinsley | D02G 3/286 57/293 |
| 5,370,804 | A | | 12/1994 | Day | |
| 5,399,616 | A | | 3/1995 | Kuhn et al. | |
| 5,465,566 | A | * | 11/1995 | Edwards | D02G 3/286 57/204 |
| 5,518,814 | A | | 5/1996 | Bonigk | |
| 5,567,400 | A | | 10/1996 | Mudge et al. | |
| 5,577,376 | A | * | 11/1996 | McAllister | D02G 3/286 57/204 |
| 5,695,377 | A | | 12/1997 | Triebes et al. | |
| 5,732,748 | A | | 3/1998 | Aucagne et al. | |
| 5,763,076 | A | * | 6/1998 | Coons, III | D02G 1/16 426/399 |
| 5,950,290 | A | | 9/1999 | Sear | |
| 6,052,983 | A | | 4/2000 | Moran et al. | |
| 6,068,805 | A | | 5/2000 | Lockridge et al. | |
| 6,077,468 | A | | 6/2000 | Jariwala et al. | |
| 6,089,009 | A | * | 7/2000 | Hand | D02G 1/161 57/282 |
| 6,207,088 | B1 | | 3/2001 | Burleigh et al. | |
| 6,345,491 | B1 | * | 2/2002 | Moran | D02G 3/286 57/282 |
| 6,468,452 | B1 | | 10/2002 | Jariwala et al. | |
| 6,494,980 | B1 | | 12/2002 | Rothemeyer et al. | |
| 6,537,662 | B1 | | 3/2003 | Kamrath et al. | |
| 6,660,218 | B2 | | 12/2003 | Davis et al. | |
| 6,722,117 | B2 | | 4/2004 | Belcher, Jr. et al. | |
| 6,834,417 | B1 | | 12/2004 | Buchmuller | |
| 7,127,784 | B2 | | 10/2006 | Goineau et al. | |
| 7,323,244 | B2 | | 1/2008 | Cho et al. | |
| 7,406,818 | B2 | | 8/2008 | Keith | |
| 7,475,459 | B2 | * | 1/2009 | Rhyne | D02G 1/205 28/220 |
| 8,246,898 | B2 | | 8/2012 | Conrad et al. | |
| 8,469,686 | B2 | | 6/2013 | Stundl et al. | |
| 8,528,310 | B2 | | 9/2013 | Ganahl et al. | |
| 8,528,615 | B2 | | 9/2013 | Colson et al. | |
| 8,685,312 | B2 | | 4/2014 | Koyama | |
| 2004/0050031 | A1 | * | 3/2004 | Gilbos | B65H 55/00 57/204 |
| 2006/0213173 | A1 | * | 9/2006 | Kolmes | D02G 3/12 57/210 |

FOREIGN PATENT DOCUMENTS

| | | | |
|---|---|---|---|
| JP | H07252727 | A | 10/1995 |
| JP | 2009052167 | A | 3/2009 |
| WO | WO-8404337 | A1 | 11/1984 |
| WO | WO-03027379 | A1 | 4/2003 |
| WO | WO-03033791 | A2 | 4/2003 |

OTHER PUBLICATIONS

European Search Report dated Jul. 18, 2018 by the European Patent Office for EP Application No. 16777393.6, which was filed on Apr. 8, 2016 and published as EP3280835 on Feb. 14, 2018 (Applicant—Shaw Industries Group, Inc.) (6 pages).

PCT/US2016/026724, filed Apr. 8, 2016, Shaw Industries Group, Inc.

* cited by examiner

YARN TEXTURIZING APPARATUS AND METHOD

CROSS-REFERENCE TO RELATED APPLICATION

This application claims priority to, and the benefit of the filing date of U.S. Provisional Patent Application No. 62/144,721, filed on Apr. 8, 2015, which is incorporated by reference herein in its entirety.

FIELD

This invention relates to an apparatus and method of texturizing yarn for carpet that exhibits improved runability of yarns in warping and tufting processes.

BACKGROUND

Twisted, plied yarns can be used to form carpet products. In known high-speed processes for producing such twisted, plied yarns, individual yarns are fed from a creel under tension to a twist block that alternately imparts "S" and "Z" twists to the individual yarns, which ply together to form twisted yarns. Typically, in these processes, to lock the twists in place, a single jet of air is used to cause entanglement between the individual yarns. However, the activation of this entanglement air must be timed to exactly coincide with the passage of a small segment of "zero-twist" yarn positioned between sequential twists and twist reversal points. Otherwise, as is often the case, the segment of yarn passes through the device without being tacked. Such skips in tacking reduce the quality of the final carpet product while also reducing efficiency.

Therefore, there is a need in the pertinent art for a means to add additional tack to yarn between twist reversals. There is a further need for means to add tack within the twist strand to minimize the rolling effect of the yarn as it is taken off in subsequent processes. There is still a further need for improving the quality of carpet products that make use of twisted, plied yarns.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed herein, in one aspect, is an apparatus and method for yarn texturizing. The yarn texturizing apparatus texturizes a plurality of yarns. The yarn texturizing apparatus has a yarn path extending between a yarn inlet port and a yarn outlet port.

In one aspect, the yarn texturing apparatus can have a tack assembly, a nip roller, a jet box assembly, and a pull roller assembly. In this aspect, the tack assembly can be configured to receive at least one bundle of yarns. In this aspect, each bundle of yarns can comprise at least two yarns from the plurality of yarns. In a further aspect, the tack assembly can also comprise conventional means for imparting a plurality of twists to each bundle of yarns that pass through the tack assembly. It is contemplated that the plurality of twists can comprise one type of twist repeated sequentially, or, optionally, the plurality of twists can comprise at least two different types of twists that are repeated sequentially as desired. In an exemplary aspect, it is contemplated that at least two different twists of the plurality of twists can comprise a S-twist and a Z-twist. In a further aspect, it is contemplated that the tack assembly can also comprise conventional means for placing a first tack point onto each bundle of yarns at a point corresponding to a twist reversal between the at least two different twists.

The nip roller can be positioned downstream of the tack assembly along the yarn path and can be configured to pull the at least one bundle of yarns through the tack assembly at a selectively adjustable speed.

The jet box assembly can be positioned downstream of the nip roller. The jet box assembly can be configured to place a plurality of additional tack points onto each bundle of yarns as the at least one bundle of yarns passes through the jet box assembly. In one exemplary aspect, the plurality of additional tack points can be placed intermittently along the plurality of twists of each bundle of yarns. In an additional aspect, the pull roller assembly can be positioned downstream of the jet box assembly along the yarn path and can be configured to pull the at least one bundle of yarns through the jet box assembly at a selectively adjustable speed.

In an additional aspect, the yarn texturing apparatus can further comprise at least one elongate body positioned upstream of the tack assembly. In one aspect, the at least one elongate body can have an inner surface that defines a bore that extends from a first end of the elongate body to an opposed second end of the elongate body. The elongate body can also, optionally, define a plurality of conduits disposed therein. In this aspect, each conduit of the plurality of conduits can be configured to guide a single yarn of the plurality of yarns along the yarn path. In this aspect, it is contemplated that the tack assembly can be configured to receive the at least one bundle of yarns from the plurality of yarns emerging from the plurality of conduits.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate aspects and together with the description, serve to explain the principles of the methods and systems.

DETAILED DESCRIPTION

Figure 1A:
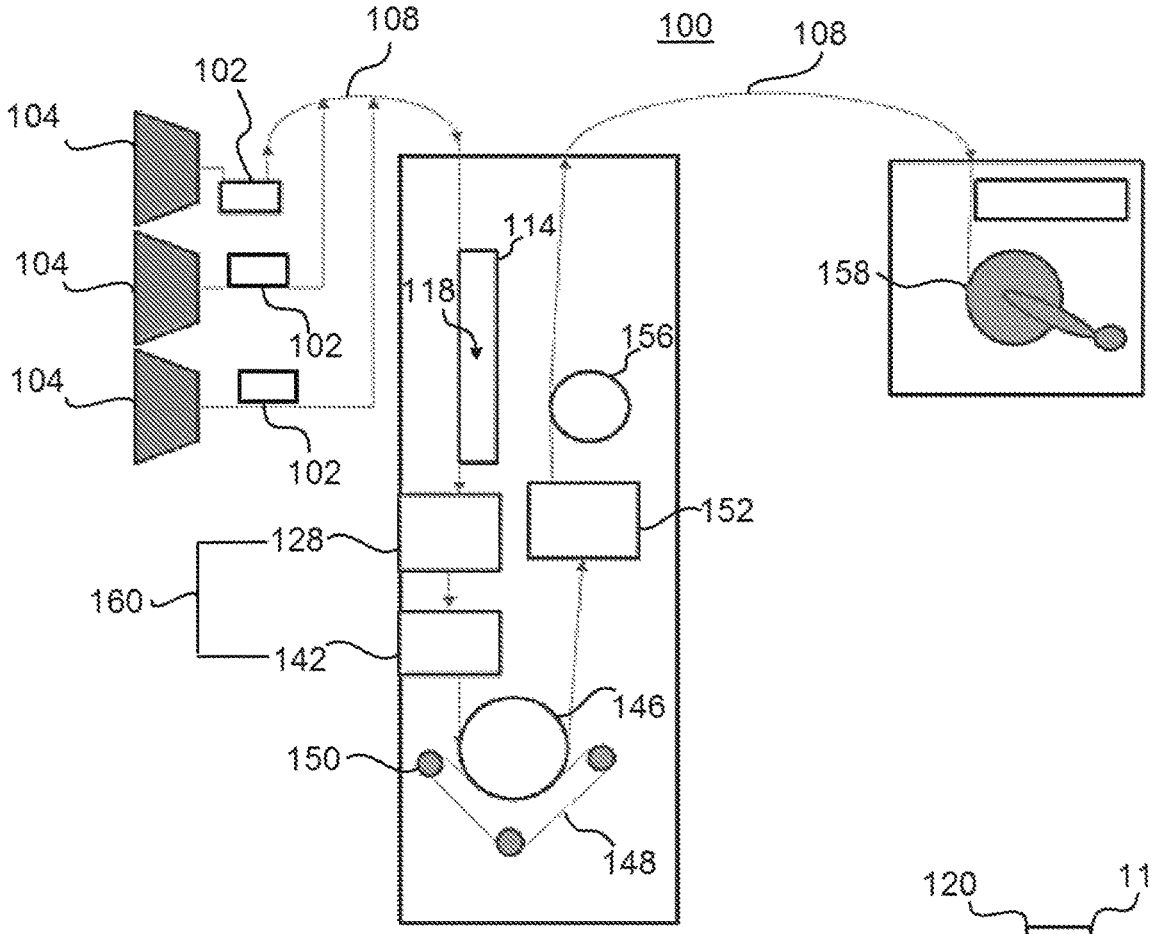
FIG. 1A depicts a schematic drawing of an exemplary yarn texturizing apparatus as described herein.

The present invention can be understood more readily by reference to the following detailed description, examples, drawings, and claims, and their previous and following descriptions. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

Reference will be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding described herein. It will be obvious, however, to one skilled in the art that the present disclosure may be practiced without these specific details. In other instances, well-known aspects of carpet manufacture have not been described in particular detail in order to avoid unnecessarily obscuring aspects of the disclosed implementations.

As used throughout, the singular forms "a," "an" and "the" include plural referents unless the context clearly dictates otherwise. Thus, for example, reference to "a bore" can include two or more such bores unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal aspect. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

The word "or" as used herein means any one member of a particular list and also includes any combination of members of that list.

Figure 1B:
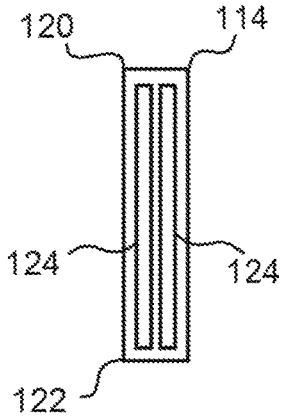
FIG. 1B is an isolated schematic drawing of an exemplary elongate body of the yarn texturing apparatus of FIG. 1A.
Figure 2:
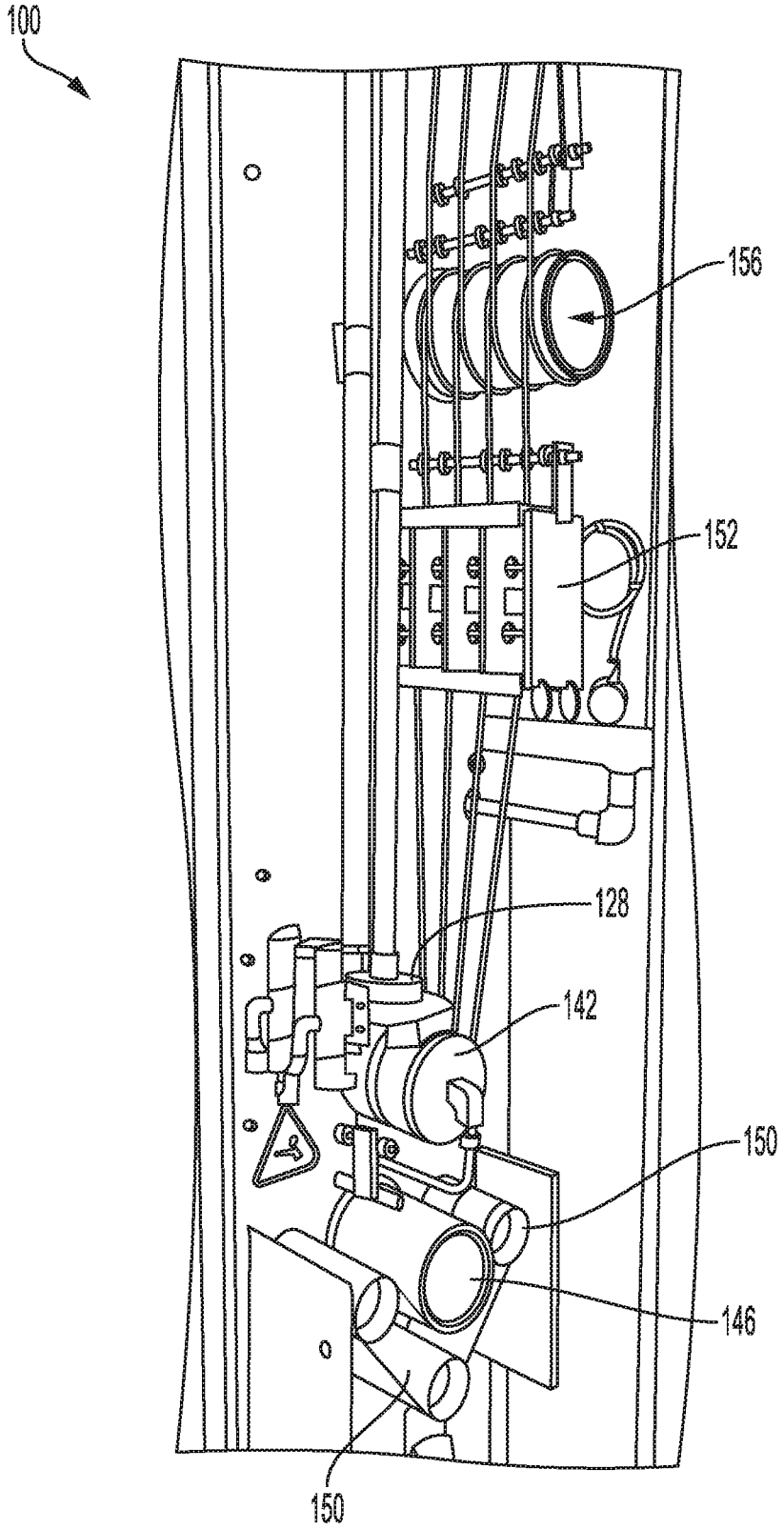
FIG. 2 depicts a perspective view of an exemplary yarn texturizing apparatus as described herein.

Implementations described herein and depicted in FIGS. 1A-6C provide for an apparatus and method of texturizing a plurality of yarns 102. Referring to FIGS. 1 and 2, one exemplary implementation of a yarn texturizing apparatus 100 is shown. Here, yarns 102 can be drawn from a creel, from one or more packages 104, or from any other means known in the art. The yarns 102 can be passed through the yarn texturizing apparatus 100. The yarn texturizing apparatus 100 can have a yarn path 108 extending between a yarn inlet port and a yarn outlet port. It is contemplated that any continuous filament yarn can be suitable for use on the disclosed apparatus 100. Such continuous filament yarns can include yarns made of nylon, polypropylene, polyethylene terephthalate, and the like.

In exemplary aspects, the yarns 102 can pass through appropriate guide means, then to a tensioning means. The tensioning means can be a pair of disks, with one side being urged towards the other by spring means so that the variation of spring tension will vary the tension on the yarns. Such a tensioning device is well-known in the art. Any tensioning means known to those skilled in the art would be appropriate. Conventional yarn guide elements can be used to ensure that the yarn follows the yarn path 108 throughout the texturing process.

In one aspect, the disclosed yarn texturizing apparatus 100 can comprise a tack assembly 160. In this aspect, the tack assembly 160 can be configured to receive at least one bundle of yarns 106. In a further aspect, each bundle of yarns 106 can comprise at least two yarns of the plurality of yarns 102. In one exemplary aspect, the tack assembly 160 can comprise means for imparting a plurality of twists to each bundle of yarns 106. As shown in FIG. 6C, the tack assembly 160 can be configured to impart at least a first and a second twist 162, 164 to each bundle of yarns 106. As further disclosed herein, it is contemplated that the first and second twists 162, 164 can correspond to different twist types, with a twist reversal point positioned between the first and second twists. It is contemplated that such twisting means can twist a section of the bundle of yarns around its own axis where the downstream sides of the bundle of yarns have a twist in one direction and the upstream sides have the same amount of opposite twist. The twist direction can be alternated periodically, and a tack can be placed at each twist reversal location. In another exemplary aspect, the tack assembly 160 can comprise means for placing a first tack point 144 onto each bundle of yarns 106 at a point corresponding to a twist reversal 170 between the first and second twists 162, 164. The means for placing a first tack point onto each bundle of yarns can comprise a roto-jet assembly as further described herein. In another exemplary aspect, the tack assembly 160 can comprise means for imparting a plurality of twists to each bundle of yarns 106. The means for imparting a plurality of twists to each bundle of yarns can comprise a twist plate assembly as further described herein. In this aspect, the plurality of twists can comprise at least two different types of twists. In a further aspect, the tack assembly 160 can comprise means for placing a first tack point 144 onto each bundle of yarns 106 at a point corresponding to a twist reversal 170 between the at least two different types of twists. One skilled in the art will appreciate that the twisted and tacked bundle of yarns that exit the tack assembly can be a plied or cabled yarn. In one aspect, it is contemplated that each yarn in the bundle of yarns can have substantially the same tension and/or substantially the same length. Further, in one exemplary aspect, the twisted and tacked bundle of yarns that exit the tack assembly can be balanced.

In one aspect, the tack assembly 160 can comprise a twist plate assembly 128 and a roto-jet assembly 142. In this aspect, the twist plate assembly 128 can be positioned downstream from at least one elongate body 114 relative to the yarn path 108. In a further aspect, the roto-jet assembly 142 can be positioned downstream of the twist plate assembly 128 relative to the yarn path 108. An example of a commercially available tack assembly is the Gilbos DynaJet System 2 manufactured by Gilbos of America, Inc. (Dalton, Ga.). However, it is contemplated that other tack assemblies can be used.

In one aspect, the twist plate assembly 128 can be configured to receive the at least one bundle of yarns 106. In a further aspect, the twist plate assembly 128 can comprise a first plurality of twist plates oriented to rotate each at least one bundle of yarns 106 in a first direction to impart a first twist 162 to the bundle of yarns. In another aspect, the twist plate assembly 128 can comprise a second plurality of twist plates oriented to rotate each bundle of the at least one bundle of yarns 106 in a second direction to impart a second twist 164 to the bundle of yarns. In exemplary aspects, as further described herein, the first and second twists 162, 164 can correspond to two different twist types. In one aspect, the first twist 162 can be an S-twist, as on any given side the yarns appear to cross diagonally in the same direction as the diagonal of a "S." In another aspect, the second twist 164 can be a Z-twist, as on any given side the yarns appear to cross diagonally in the same direction as the diagonal of a "Z." It is contemplated that the first and second pluralities of twist plates can rotate in a range between 1 TPI (turn per inch) to 4 TPI in both the first and second directions. It is further contemplated that the first and second pluralities of twist plates can rotate in a range between 1.9 TPI to 2.1 TPI.

In one aspect, the roto-jet assembly 142 can be configured to place a first tack point 144 in each bundle of yarns 106 at a point corresponding to a twist reversal 170 between the first twist 162 and the second twist 164 of each bundle of yarns as the at least one bundle of yarns passes through the roto-jet assembly. Such tacking can help fix the twisting direction and arrangement of the at least one bundle of yarn 106.

Air can be supplied to the roto-jet assembly 142 from a source of pressurized air by means of solenoid valves controlled by any conventional means and in one exemplary aspect, by electronic means. It is contemplated that the roto-jet assembly 142 can be any air jet entangler apparatus known in the art. Examples of such air jet entangler assemblies include, without limitation, air jet assemblies manufactured by, for example and without limitation, Saurer Components GmbH (Temco), Gilbos of America, Inc., and the like. The roto-jet assembly 142 can comprise a conventional air tacking jet positioned adjacent and/or along the flow path of the bundle of yarn 106 through the roto-jet assembly 128. In this aspect, the roto-jet assembly 142 can direct an air stream onto at least a portion of the bundle of yarns 106. When the bundle of yarns 106 emerges from the air tacking jet, the yarns have been entangled so that there are a plurality of bulked portions along the twisted bundle of yarn 106 separated by at least one area in which the yarns are tacked together.

In one aspect, the disclosed yarn texturizing apparatus 100 can comprise at least one elongate body 114 that can be positioned upstream of the tack assembly 160. In this aspect, the at least one elongate body 114 can have an inner surface 116 that defines a bore 118 that can extend from a first end of the elongate body 120 to a second end of the elongate body 122. Optionally, in one aspect, the elongate body 114 can also define a plurality of conduits 124 disposed therein. Each conduit 124 of the plurality of conduits can be configured to guide a respective (single) yarn 102 of the plurality of yarns along the yarn path 108. In this aspect, the tack assembly 160 can be configured to receive the at least one bundle of yarns 106 from the plurality of yarns 102 emerging from the plurality of conduits 124. It is contemplated that the plurality of yarns 102 fed through the conduits 124 can comprise at least two different colored yarns.

Figure 3:
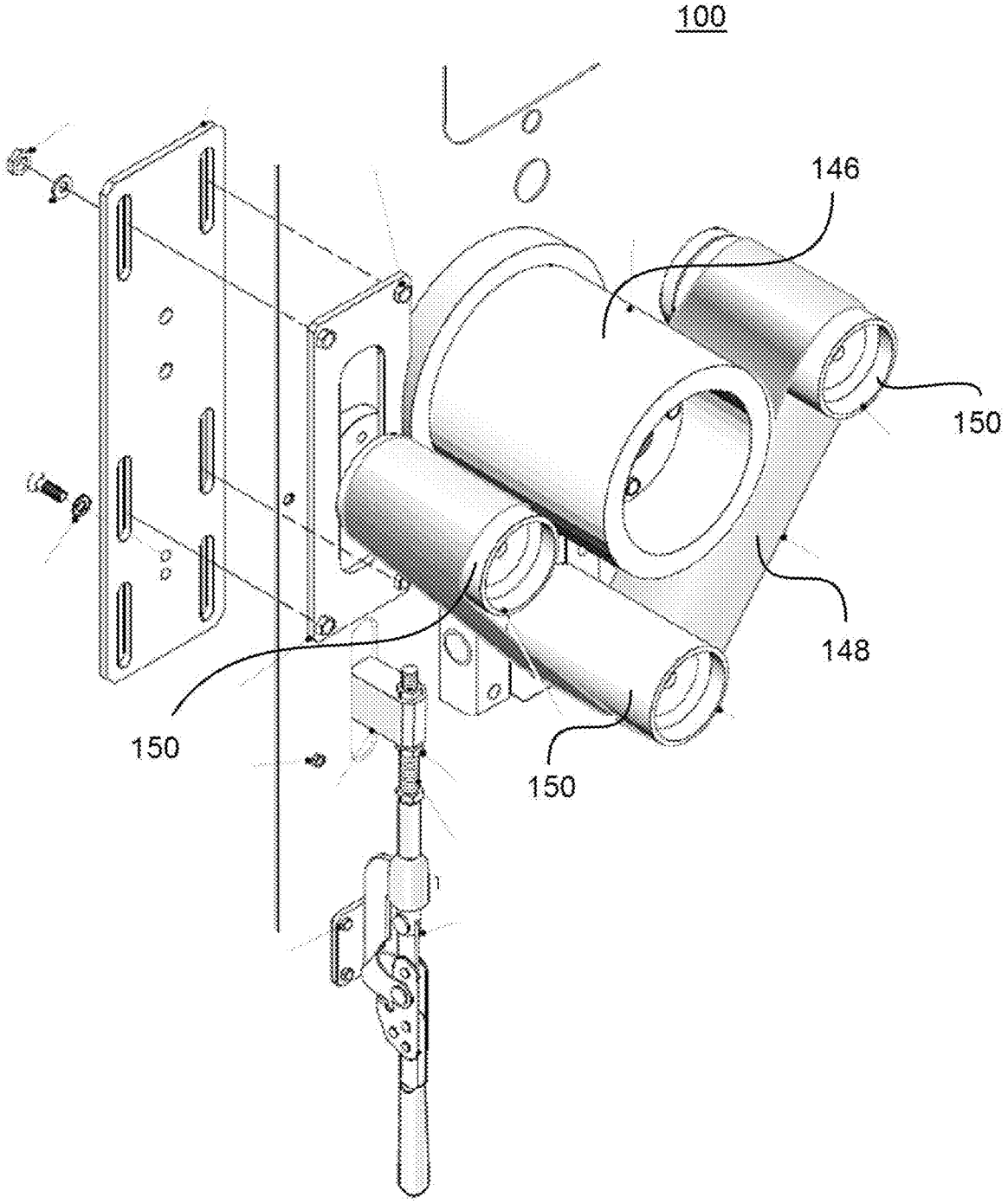
FIG. 3 depicts a partially exploded perspective view of an exemplary nip roller of the yarn texturizing apparatus as described herein.

In another aspect, the yarn texturizing apparatus 100 can comprise a nip roller 146 rotatably coupled (e.g., mounted) to a portion of the yarn texturizing apparatus, as depicted in FIG. 3. The nip roller 146 can comprise a driven flat belt 148 that can be operably associated with a plurality of rollers 150. The nip roller 146 can be located downstream of the tack assembly 160 along the yarn path 108. In this aspect, it is contemplated that the nip roller 146 can be configured to pull the at least one bundle of yarns 106 through the tack assembly 160 at a selectively adjustable speed. It is further contemplated that the nip roller speed can be adjusted to increase or decrease tension in the at least one bundle of yarns 106 before proceeding to the next stage in the process. In one exemplary aspect, the speed of the nip roller 146 can range from between about 300 ypm to about 800 ypm. In another exemplary aspect, the speed of the nip roller 146 can range from between about 430 ypm to about 600 ypm. As shown in FIG. 1A, the nip roller 146, the driven flat belt 148, and the plurality of rollers 150 can be positioned to adjust the direction of the yarn path 108 (optionally, to substantially reverse the direction of the yarn path) as the yarn bundle is driven in a downstream direction by the nip roller 146. It is contemplated that this adjustment of the direction of the yarn path 108 can be used to limit the overall profile and size of the yarn texturing apparatus 100.

Figure 4A:
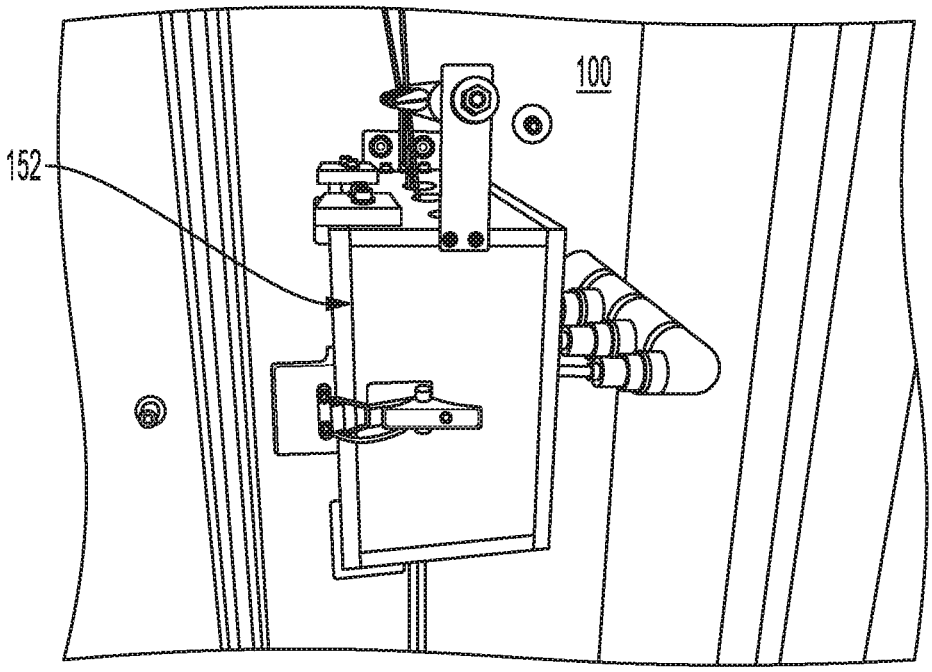
FIG. 4A depicts a perspective view of the exterior area of an exemplary jet box assembly of the yarn texturizing apparatus as described herein.
Figure 4B:
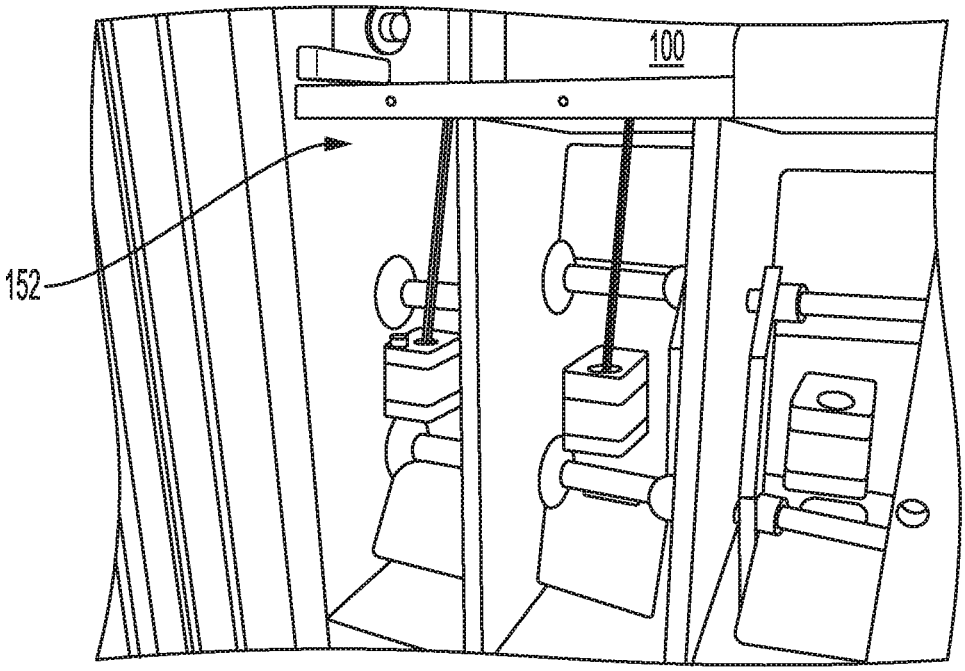
FIG. 4B depicts a perspective view of the interior area of an exemplary jet box assembly of a yarn texturizing apparatus as described herein.

In another aspect, as depicted in FIGS. 4A and 4B, the yarn texturizing apparatus 100 can comprise a jet box assembly 152. In exemplary aspects, the jet box assembly 152 can comprise a housing and at least one compartment (optionally, a plurality of compartments) defined within the housing. In these aspects, it is contemplated that each compartment of the housing can be configured to receive a respective yarn bundle from the nip roller 146, It is further contemplated that each compartment can be provided with respective components that are configured to create additional tack points on the yarn bundle as the yarn bundle passes through the compartment and the housing. FIG. 4A depicts a perspective view of an exterior portion of an exemplary jet box assembly 152, and FIG. 4B depicts a perspective view of an interior portion of an exemplary jet box assembly. In one aspect, as further disclosed herein, the jet box assembly 152 can be positioned downstream of the nip roller 146 relative to the yarn path 108. As shown in FIG. 4B, the jet box assembly can comprise at least one tack jet as is known in the art, which is configured to selectively apply a jet of air to create further yarn entanglement. It is contemplated that each tack jet of the jet box assembly 152 can be configured to place a tack onto the at least one bundle of yarns 106 as further disclosed herein. Conventional air-entanglement tack jets can be used; however, it is contemplated that other air jet assemblies can be used. In one exemplary aspect, the jet box assembly 152 can be configured to place at least one additional tack point to each bundle of yarns as the twisted and tacked at least one bundle of yarns 106 passes through the jet box assembly. In another exemplary aspect, the jet box assembly 152 can be configured to place a plurality of additional tack points 154 to each twisted and tacked bundle of yarns as the twisted and tacked at least one bundle of yarns 106 passes through the jet box assembly. Thus, in use, the tack assembly 160 and the jet box assembly 152 function as two distinct locations along the yarn stream where tack points can be applied to a yarn bundle. In one aspect, the plurality of additional tack points 154 can be placed intermittently along the plurality of twists of each bundle of yarns 106. In another aspect, the plurality of additional tack points 154 can be placed intermittently along the first and second twists 162, 164 of each bundle of yarns 106. In yet another aspect, the plurality of additional tack points 154 can be placed intermittently along the S-twist 162 and the Z-twist 164 portions of each bundle of yarns 106. Thus, in use, the jet box assemble 152 can allow for the production of twisted yarn bundles having tack points at twist reversal points as well as at intermittent locations between twist reversal points. In these aspects, as described herein, the jet box assembly 152 can direct an air stream onto at least a portion of the bundle of yarns 106 to form the tack points.

In one exemplary aspect, the jet box assembly 152 can comprise a plurality of tack jets, with each tack jet being positioned to direct an air stream into a respective compartment of the jet box assembly. In further exemplary aspects, it is contemplated that the housing of the jet box assembly can comprise at least one yarn inlet opening and at least one yarn outlet opening for receiving a yarn bundle and passing a yarn bundle to the pull roller assembly as further disclosed herein. Optionally, when the jet box assembly comprises a plurality of compartments, it is contemplated that a respective yarn inlet opening and yarn outlet opening can be provided in communication with each compartment. In further exemplary aspects, it is contemplated that the housing can define one or more tack jet openings for receiving at least a portion of a respective tack jet to permit delivery of air from the tack jet into the housing of the jet box assembly. In these aspects, where multiple compartments are provided, it is contemplated that a respective tack jet opening can be positioned in communication with each compartment. In still further aspects, it is contemplated that the tack jet openings can be configured to receive the tack jets such that the air delivered by the tack jets is applied substantially perpendicularly relative to the yarn path. In still further exemplary aspects, it is contemplated that the jet box assembly 152 can comprise instrumentation for controlling the operation of the tack jets of the jet box assembly. In exemplary aspects, the housing can receive at least a portion of such instrumentation, which can optionally comprise at least one servo valve and/or servo motor that is communicatively coupled to a respective tack jet to control operation of the tack jet. Optionally, in these aspects, when the housing defines a plurality of compartments, each compartment can receive at least a portion of a tack jet and the control instrumentation associated with the tack jet. In still further aspects, the jet box assembly 152 can comprise conventional yarn guide elements that control the location and orientation of the yarn bundles as they travel through the housing of the jet box assembly. Optionally, in these aspects, the yarn guide elements can be positioned at least partially within the housing of the jet box assembly 152.

The resultant twisted and tacked at least one bundle of yarns 106 exhibits many improvements over conventional twisted yarns, such as yarns formed by a ROTOTWIST process. In one aspect, the twisted and tacked at least one bundle of yarns 106 exhibits an increased ability to run twisted yarns on tufting machines, as the additional tack imparted to the yarn decreases the tendency of the twisted and tacked at least one bundle of yarns to roll off the yarn cone as the yarn slack is taken up. In another aspect, the twisted and tacked at least one bundle of yarns 106 exhibits decreased skips as compared to conventional rototwist yarn, which is a result of the additional tacking at the twist reversals 170. This improvement can further enable improvement in straight-stitched tri-colored (or barber pole) bundles of yarn by reducing the short term striations and by reducing or eliminating shifting at tufting on products that are 100% A thread-up. In yet another aspect, the disclosed apparatus 100 and methods can enable production of airtwist-like yarn using ROTOTWIST equipment that has been improved and modified as disclosed herein.

Figure 5:
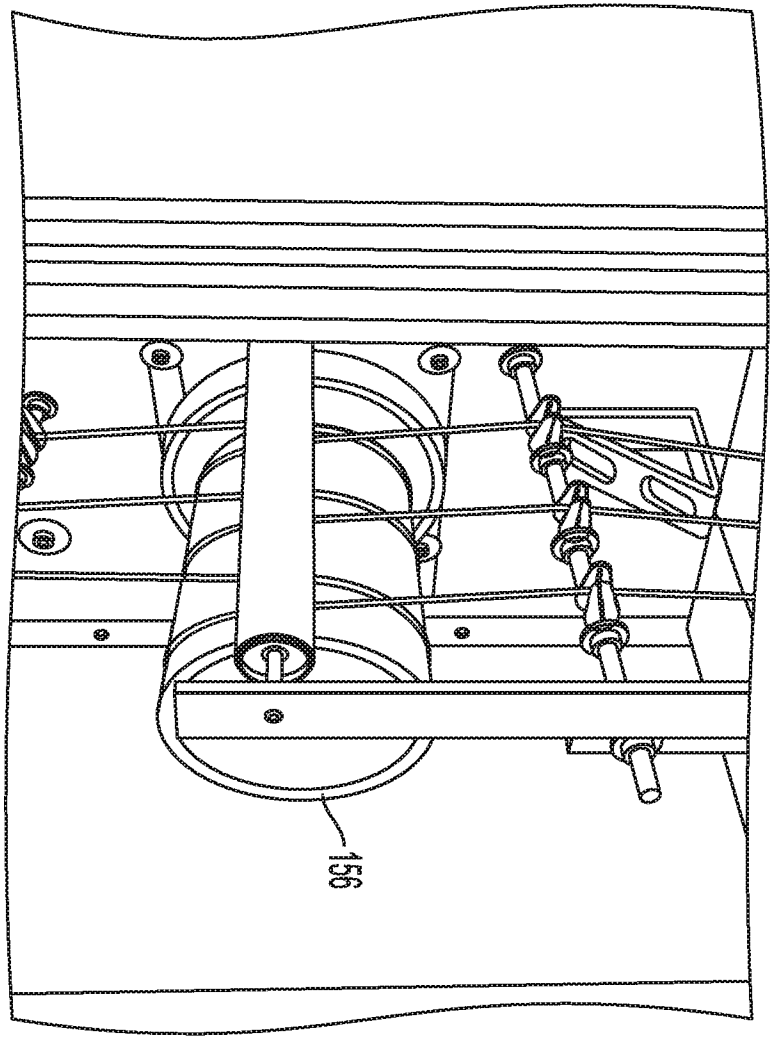
FIG. 5 is a perspective view of an exemplary pull roller as disclosed herein.

In another aspect, as shown in FIG. 5, the yarn texturizing apparatus 100 can comprise a pull roller assembly 156 that can be positioned downstream of the jet box assembly 152 along the yarn path 108. In this aspect, the pull roller assembly 156 can be configured to pull the twisted and tacked at least one bundle of yarns 106 through the jet box assembly 152 at a selectively adjustable speed. In one exemplary aspect, the speed of the pull roller can range from between about 310 ypm to about 850 ypm. In another exemplary aspect, the speed of the pull roller can range from between about 450 ypm to about 650 ypm. It is contemplated that the pull roller 156 can run at least about 5% faster than the nip roller 146 to maintain a constant tension between the rollers 146, 156. The tension can be adjusted by changing the speed on the nip roller 146 and/or the pull roller 156.

In a further aspect, the yarn texturizing apparatus 100 can comprise a means for feeding the bundle of yarn 106 through the yarn texturizing apparatus. In one aspect, the means for feeding the bundle of yarn 106 through the yarn texturizing apparatus 100 can comprise a winder 158. In a further aspect, the winder 158 can be positioned downstream of the pull roller assembly 156. As one skilled in the art would appreciate, there are a number of conventional means for feeding the yarn through the apparatus. It has been contemplated to manually feed the yarn ends through the yarn texturizing apparatus 100. It has also been contemplated to use a mechanical winder to pull the yarn through the yarn texturizing apparatus 100. It is further contemplated that the yarn can be fed using drive rolls positioned downstream of the roto-jet assembly 142, such as the nip roller 146 described herein.

Figure 6A:
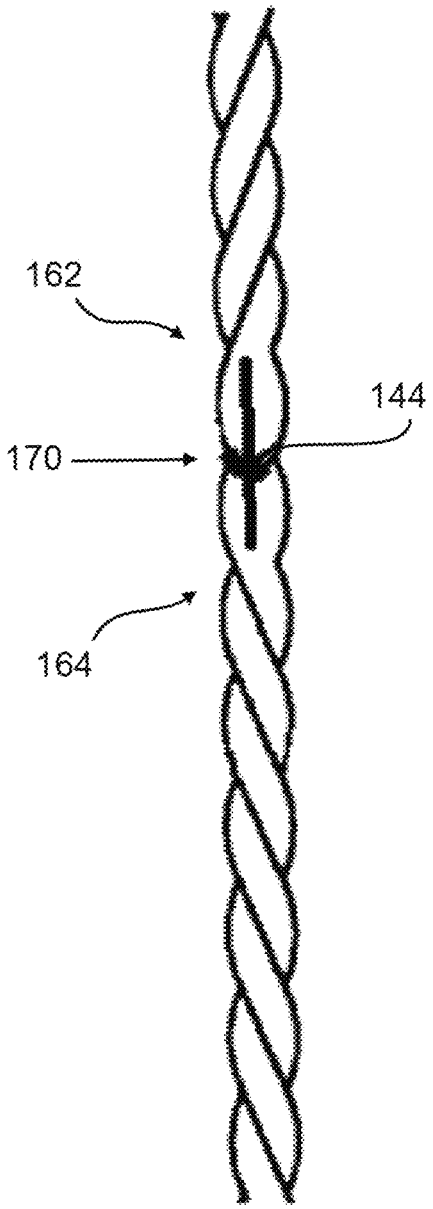
FIG. 6A depicts a drawing of an exemplary bundle of yarn that has a first tack point imparted at a twist reversal after the bundle of yarn passes through a roto-jet assembly.
Figure 6B:
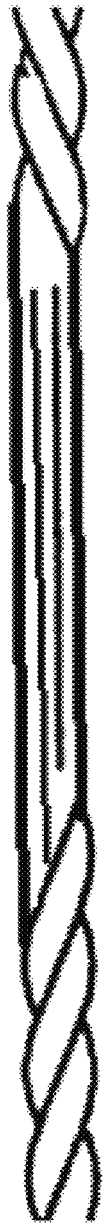
FIG. 6B depicts a drawing of an exemplary bundle of yarn that has a missed tack point at the twist reversal as the bundle of yarn passes through the roto-jet assembly.
Figure 6C:
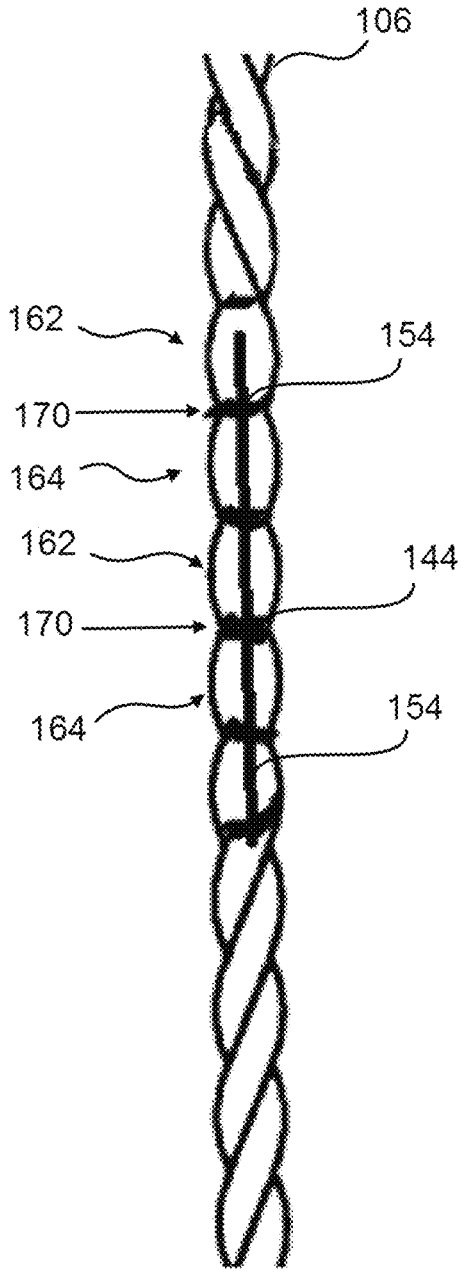
FIG. 6C depicts a drawing of an exemplary bundle of yarn that has a plurality of additional tack points imparted to the bundle of yarn after the bundle of yarn passes through a jet box assembly.

Referring now to FIGS. 6A-6C, the bundle of yarn is illustrated as having a first tack point, a missed tack point, and a plurality of additional tack points. In particular, FIG. 6A depicts a drawing of an exemplary bundle of yarn that has a first tack point 144 imparted at a twist reversal 170 between the S-twist 162 and the Z-twist 164 portions of the bundle of yarn after the bundle of yarn passes through a roto-jet assembly 142. FIG. 6B depicts a drawing of an exemplary bundle of yarn that has a missed tack point at the twist reversal of the bundle of yarn as the bundle of yarn passes through the roto-jet assembly. Such a missed tack point can cause individual yarns to run parallel to one another, resulting in a skip ranging from about 3 inches to about 6 inches in length. These skips can cause streaks in carpet products. FIG. 6C depicts a drawing of an exemplary bundle of yarn 106 that has a plurality of additional tack points 154 imparted to the bundle of yarn after the bundle of yarn passes through a jet box assembly 152.

Accordingly, FIGS. 1A-6C, and the corresponding text, provide a number of different configurations for assemblies used to manufacture a bundle of yarn, as well as subassemblies and methods to form the different configurations thereof. In addition to the foregoing, implementations described herein can also be described in terms of acts and steps in a method for accomplishing a particular result. For example, a method for texturizing a plurality of yarns can utilize a yarn texturizing apparatus that has a yarn path that extends between a yarn inlet port and a yarn outlet port. Initially, it is contemplated that at least two yarns, which form a respective bundle of yarns, selected from a plurality of yarns are fed to a tack assembly such that the tack assembly can impart a plurality of twists to the respective bundle of yarns and sequentially set at least one tack point (optionally, a plurality of tack points) on each bundle of yarn. In one aspect, it is contemplated that the plurality of twists comprises at least a first twist type and a second twist type and that the respective twists of the first type are twisted in an opposite or opposing direction to the twists of the second type. In a further aspect, it is contemplated that the tack points formed by the tack assembly can be positioned at points corresponding to a twist reversal between the opposing first and second twists for each bundle of yarns.

In a further aspect, the method can comprise pulling each bundle of yarns through the tack assembly at a selectively adjustable speed and subsequently pulling the twisted and tacked bundle of yarns through the jet box assembly at a selectively adjustable speed. While the twisted and tacked bundle of yarns is being drawn through the jet box assembly, it is contemplated that the method can further comprise sequentially setting a plurality of additional tack points on each bundle of yarns. In this aspect, each additional tack point can be positioned intermittently along the twists of each bundle of yarn. Thus, it is contemplated that additional tack points can be positioned at additional twist reversal locations and/or at locations positioned in between twist reversal locations. In yet another aspect, the method can comprise winding up the yarn that exits the jet box assembly.

Exemplary Aspects

In view of the described yarn texturing apparatus and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A yarn texturizing apparatus for texturizing a plurality of yarns, wherein the yarn texturizing apparatus has a yarn path extending between a yarn inlet port and a yarn outlet port, comprising: a tack assembly configured to receive at least one bundle of yarns, wherein each bundle of yarns comprises at least two yarns of the plurality of yarns, wherein the tack assembly is configured to impart at least a first and a second twist onto each bundle of yarns, and wherein the tack assembly is further configured to place a first tack point onto each bundle of yarns at a point corresponding to a twist reversal between the first and second twists; a nip roller located downstream of the tack assembly along the yarn path, wherein the nip roller is configured to pull the at least one bundle of yarns through the tack assembly at a selectively adjustable speed; a jet box assembly positioned downstream of the nip roller relative to the yarn path, wherein the jet box assembly is configured to place a plurality of additional tack points onto each bundle of yarns as the at least one bundle of yarns passes through the jet box assembly, wherein the plurality of additional tack points are placed intermittently along the twists of each bundle of yarns; and a pull roller assembly positioned downstream of the jet box assembly along the yarn path, wherein the pull roller assembly is configured to pull the at least one bundle of yarns through the jet box assembly at a selectively adjustable speed.

Aspect 2: The yarn apparatus of Aspect 1, further comprising at least one elongate body positioned upstream of the tack assembly, the at least one elongate body having an inner surface that defines a bore that extends from a first end of the elongate body to an opposed second end of the elongate body and a plurality of conduits disposed therein, wherein each conduit of the plurality of conduits is configured to guide a single yarn of the plurality of yarns along the yarn path, and wherein the tack assembly is configured to receive the at least one bundle of yarns from the plurality of yarns emerging from the plurality of conduits.

Aspect 3: The yarn texturizing apparatus of Aspect 2, wherein the tack assembly comprises: a twist plate assembly positioned downstream from the at least one elongate body relative to the yarn path; and a roto-jet assembly positioned downstream of the twist plate assembly relative to the yarn path.

Aspect 4: The yarn texturizing apparatus of Aspect 3, wherein the twist plate assembly is configured to receive the at least one bundle of yarns, wherein the twist plate assembly comprises: a first plurality of twist plates oriented to rotate the at least one bundle of yarns in a first direction to impart the first twist to each bundle of yarns; and a second plurality of twist plates oriented to rotate the at least one bundle of yarns in a second direction to impart the second twist to each bundle of yarns.

Aspect 5: The yarn texturizing apparatus of Aspect 3, wherein the roto-jet is configured to place a first tack point in the bundle of yarns at a point corresponding to a twist reversal between the first twist and the second twist of the bundle of yarns as the bundle of yarns passes through the roto-jet assembly.

Aspect 6: The yarn texturizing apparatus of Aspect 5, wherein the first twist is a twist and and the second twist is a Z-twist.

Aspect 7: The yarn texturizing apparatus of Aspect 1, further comprising a winder that is positioned downstream of the pull roller assembly, wherein the winder is configured to pull the yarn through the yarn texturizing apparatus.

Aspect 8: The yarn texturizing apparatus of Aspect 1, wherein the yarn texturizing apparatus is configured to receive at least one continuous filament yarn.

Aspect 9: The yarn texturizing apparatus of Aspect 8, wherein the continuous filament yarn comprises nylon, polypropylene, or polyethylene terephthalate yarns.

Aspect 10: The yarn texturizing apparatus of Aspect 1, wherein the plurality of yarns comprises at least two different colored yarns.

Aspect 11: The yarn texturizing apparatus of Aspect 4, wherein the first and second plurality of twist plates rotate in a range between 1.9 turns per inch (TN) to 2.1 TN in both the first and second directions.

Aspect 12: The yarn texturizing apparatus of Aspect 1, wherein the nip roller is configured to operate at speeds ranging from about 300 to about 800 ypm.

Aspect 13: The yarn texturizing apparatus of Aspect 1, wherein the speed of the pull roller assembly is selected to run at a speed that is about 5% faster than the speed of the nip roller.

Aspect 14: The yarn texturizing apparatus of Aspect 1, wherein the speed of the pull roller assembly is selected to run at a speed that is at least 5% faster than the speed of the nip roller.

Aspect 15: The yarn texturizing apparatus of Aspect 1, wherein the nip roller comprises a driven flat belt operably associated with a plurality of rollers.

Aspect 16: The yarn texturing apparatus of Aspect 1, wherein at least one of the additional tack points on the bundle of yarns is positioned between sequential twist reversals.

Aspect 17: A yarn texturizing apparatus for texturizing a plurality of yarns, wherein the yarn texturizing apparatus has a yarn path extending between a yarn inlet port and a yarn outlet port, comprising: a tack assembly configured to receive at least one bundle of yarns, wherein each bundle of yarns comprises at least two yarns of the plurality of yarns, the tack assembly being configured to impart a plurality of twists to each bundle of yarns, wherein the plurality of twists comprises at least two different twists, and wherein the tack assembly is further configured to place a first tack point onto each bundle of yarns at a point corresponding to a twist reversal between the at least two different twists; a nip roller comprising a driven flat belt operably associated with a plurality of rollers, wherein the nip roller is located downstream of the tack assembly along the yarn path, wherein the nip roller is configured to pull the at least one bundle of yarns through the tack assembly at a selectively adjustable speed; a jet box assembly positioned downstream of the nip roller relative to the yarn path, wherein the jet box assembly is configured to place a plurality of additional tack points onto each bundle of yarns as the at least one bundle of yarns passes through the jet box assembly, wherein the plurality of additional tack points are placed intermittently along the plurality of twists of each bundle of yarns; and a pull roller assembly positioned downstream of the jet box assembly along the yarn path, wherein the pull roller assembly is configured to pull the at least one bundle of yarns through the jet box assembly at a selectively adjustable speed.

Aspect 18: The yarn texturing apparatus of Aspect 17, further comprising at least one elongate body positioned upstream of the tack assembly, the at least one elongate body having an inner surface that defines a bore that extends from a first end of the elongate body to an opposed second end of the elongate body and a plurality of conduits disposed therein, wherein each conduit of the plurality of conduits is configured to guide a single yarn of the plurality of yarns along the yarn path, and wherein the tack assembly is configured to receive the at least one bundle of yarns from the plurality of yarns emerging from the plurality of conduits.

Aspect 19: The yarn texturizing apparatus of Aspect 18, wherein the tack assembly comprises: a twist plate assembly positioned downstream from the at least one elongate body relative to the yarn path; and a roto-jet assembly positioned downstream of the twist plate assembly relative to the yarn path.

Aspect 20: The yarn texturizing apparatus of Aspect 19, wherein the twist plate assembly is configured to receive the at least one bundle of yarns, wherein the twist plate assembly comprises: a first plurality of twist plates oriented to rotate each at least one bundle of yarns in a first direction to impart a first twist to the bundle of yarns; and a second plurality of twist plates oriented to rotate each at least one bundle of yarns in a second direction to impart a second twist to the bundle of yarns.

Aspect 21: The yarn texturizing apparatus of Aspect 20, wherein the roto-jet is configured to place a first tack point in each bundle of yarns at a point corresponding to a twist reversal between the first twist and the second twist of each bundle of yarns as the at least one bundle of yarns passes through the roto-jet assembly.

Aspect 22: The yarn texturizing apparatus of Aspect 21, rein the first twist is a S-twist and the second twist is a Z-twist.

Aspect 23: The yarn texturing apparatus of Aspect 17, wherein at least one of the additional tack points on the bundle of yarns is positioned between sequential twist reversals.

Aspect 24: A method for texturizing a plurality of yarns, comprising: imparting a plurality of twists to a bundle of yarns, wherein the bundle of yarns comprises at least two yarns, wherein the plurality of twists comprises at least a first twist and a second twist; sequentially setting a plurality of tack points on the bundle of yarns, each tack point being positioned at a point corresponding to a twist reversal between the first and second twists; and sequentially setting a plurality of additional tack points on the bundle of yarns, each additional tack point being positioned intermittently along the respective first and second twists of the bundle of yarns.

Aspect 25: The method of Aspect 24, wherein at least one of the additional tack points on the bundle of yarns is positioned between sequential twist reversals.

The present invention can thus be embodied in other specific forms without departing from its spirit or essential characteristics. The described aspects are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A yarn texturizing apparatus for texturizing a plurality of yarns, wherein the yarn texturizing apparatus has a yarn path extending between a yarn inlet port and a yarn outlet port, comprising:

a tack assembly configured to receive at least one bundle of yarns, wherein each bundle of yarns comprises at least two yarns of the plurality of yarns, wherein the tack assembly is configured to impart at least a first and a second twist onto each bundle of yarns, and wherein the tack assembly is further configured to place a first tack point onto each bundle of yarns at a point corresponding to a twist reversal between the first and second twists;

a nip roller located downstream of the tack assembly along the yarn path, wherein the nip roller is configured to pull the at least one bundle of yarns through the tack assembly at a selectively adjustable speed;

a jet box assembly positioned downstream of the nip roller relative to the yarn path, wherein the jet box assembly is configured to place a plurality of additional tack points onto each bundle of yarns as the at least one bundle of yarns passes through the jet box assembly, wherein the plurality of additional tack points are placed intermittently along the twists of each bundle of yarns;

a pull roller assembly positioned downstream of the jet box assembly along the yarn path, wherein the pull roller assembly is configured to pull the at least one bundle of yarns through the jet box assembly at a selectively adjustable speed; and at least one elongate body positioned upstream of the tack assembly, the at least one elongate body having an inner surface that defines a bore that extends from a first end of the elongate body to an opposed second end of the elongate body and a plurality of conduits disposed therein, wherein each conduit of the plurality of conduits is configured to guide a single yarn of the plurality of yarns along the yarn path, and wherein the tack assembly is configured to receive the at least one bundle of yarns from the plurality of yarns emerging from the plurality of conduits.

2. The yarn texturizing apparatus of claim 1, wherein the tack assembly comprises:

a twist plate assembly positioned downstream from the at least one elongate body relative to the yarn path; and a roto-jet assembly positioned downstream of the twist plate assembly relative to the yarn path.

3. The yarn texturizing apparatus of claim 2, wherein the twist plate assembly is configured to receive the at least one bundle of yarns, wherein the twist plate assembly comprises:

a first plurality of twist plates oriented to rotate the at least one bundle of yarns in a first direction to impart the first twist to each bundle of yarns; and a second plurality of twist plates oriented to rotate the at least one bundle of yarns in a second direction to impart the second twist to each bundle of yarns.

4. The yarn texturizing apparatus of claim 2, wherein the roto-jet assembly is configured to place a first tack point in the bundle of yarns at a point corresponding to a twist reversal between the first twist and the second twist of the bundle of yarns as the bundle of yarns passes through the roto-jet assembly.

5. The yarn texturizing apparatus of claim 4, wherein the first twist is a S-twist and the second twist is a Z-twist.

6. The yarn texturizing apparatus of claim 1, further comprising a winder that is positioned downstream of the pull roller assembly, wherein the winder is configured to pull the yarn through the yarn texturizing apparatus.

7. The yarn texturizing apparatus of claim 1, wherein the yarn texturizing apparatus is configured to receive at least one continuous filament yarn.

8. The yarn texturizing apparatus of claim 7, wherein the continuous filament yarn comprises nylon, polypropylene, or polyethylene terephthalate yarns.

9. The yarn texturizing apparatus of claim 1, wherein the plurality of yarns comprises at least two different colored yarns.

10. The yarn texturizing apparatus of claim 3, wherein the first and second plurality of twist plates rotate in a range between 1.9 turns per inch (TPI) to 2.1 TPI in both the first and second directions.

11. The yarn texturizing apparatus of claim 1, wherein the nip roller is configured to operate at speeds ranging from 300 to 800 ypm.

12. The yarn texturizing apparatus of claim 1, wherein the speed of the pull roller assembly is selected to run at a speed that is at least 5% faster than the speed of the nip roller.

13. The yarn texturizing apparatus of claim 1, wherein the nip roller comprises a driven flat belt operably associated with a plurality of rollers.

14. The yarn texturing apparatus of claim 1, wherein at least one of the additional tack points on the bundle of yarns is positioned between sequential twist reversals.

15. A yarn texturizing apparatus for texturizing a plurality of yarns, wherein the yarn texturizing apparatus has a yarn path extending between a yarn inlet port and a yarn outlet port, comprising:

a tack assembly configured to receive at least one bundle of yarns, wherein each bundle of yarns comprises at least two yarns of the plurality of yarns, the tack assembly being configured to impart a plurality of twists to each bundle of yarns, wherein the plurality of twists comprises at least two different twists, and wherein the tack assembly is further configured to place a first tack point onto each bundle of yarns at a point corresponding to a twist reversal between the at least two different twists;

a nip roller comprising a driven flat belt operably associated with a plurality of rollers, wherein the nip roller is located downstream of the tack assembly along the yarn path, wherein the nip roller is configured to pull the at least one bundle of yarns through the tack assembly at a selectively adjustable speed;

a jet box assembly positioned downstream of the nip roller relative to the yarn path, wherein the jet box assembly is configured to place a plurality of additional tack points onto each bundle of yarns as the at least one bundle of yarns passes through the jet box assembly, wherein the plurality of additional tack points are placed intermittently along the plurality of twists of each bundle of yarns;

a pull roller assembly positioned downstream of the jet box assembly along the yarn path, wherein the pull roller assembly is configured to pull the at least one bundle of yarns through the jet box assembly at a selectively adjustable speed; and at least one elongate body positioned upstream of the tack assembly, the at least one elongate body having an inner surface that defines a bore that extends from a first end of the elongate body to an opposed second end of the elongate body and a plurality of conduits disposed therein, wherein each conduit of the plurality of conduits is configured to guide a single yarn of the plurality of yarns along the yarn path, and wherein the tack assembly is configured to receive the at least one bundle of yarns from the plurality of yarns emerging from the plurality of conduits.

16. The yarn texturizing apparatus of claim 15, wherein the tack assembly comprises:

a twist plate assembly positioned downstream from the at least one elongate body relative to the yarn path; and a roto-jet assembly positioned downstream of the twist plate assembly relative to the yarn path.

17. The yarn texturizing apparatus of claim 16, wherein the twist plate assembly is configured to receive the at least one bundle of yarns, wherein the twist plate assembly comprises:

a first plurality of twist plates oriented to rotate each at least one bundle of yarns in a first direction to impart a first twist to the bundle of yarns; and a second plurality of twist plates oriented to rotate each at least one bundle of yarns in a second direction to impart a second twist to the bundle of yarns.

18. The yarn texturizing apparatus of claim 17, wherein the roto-jet assembly is configured to place a first tack point in each bundle of yarns at a point corresponding to a twist reversal between the first twist and the second twist of each bundle of yarns as the at least one bundle of yarns passes through the roto-jet assembly.

19. The yarn texturizing apparatus of claim 18, wherein the first twist is a S-twist and the second twist is a Z-twist.

20. The yarn texturing apparatus of claim 15, wherein at least one of the additional tack points on the bundle of yarns is positioned between sequential twist reversals.

* * * * *